US009653023B2

(12) United States Patent
Kim

(10) Patent No.: US 9,653,023 B2
(45) Date of Patent: May 16, 2017

(54) DISPLAY DEVICES

(71) Applicant: Samsung Display Co., Ltd., Yongin, Gyeonggi-do (KR)

(72) Inventor: Chang-Yeop Kim, Cheonan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 162 days.

(21) Appl. No.: 14/719,103

(22) Filed: May 21, 2015

(65) Prior Publication Data

US 2016/0180818 A1 Jun. 23, 2016

(30) Foreign Application Priority Data

Dec. 18, 2014 (KR) ..... 10-2014-0183323

(51) Int. Cl.
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2310/0262* (2013.01); *G09G 2320/0219* (2013.01); *G09G 2320/043* (2013.01)

(58) Field of Classification Search
None
See application file for complete search history.

(56) References Cited

U.S. PATENT DOCUMENTS

2012/0139820 A1* 6/2012 Senda ..... G09G 3/003 345/76
2012/0212517 A1* 8/2012 Ahn ..... G11C 19/28 345/690

FOREIGN PATENT DOCUMENTS

| | | | |
|---|---|---|---|
| JP | 2009-163255 | A | 7/2009 |
| KR | 10-2005-0045094 | A | 5/2005 |
| KR | 10-0802334 | B1 | 1/2008 |
| KR | 10-2012-0009904 | A | 2/2012 |
| KR | 10-2013-0098612 | A | 9/2013 |

* cited by examiner

*Primary Examiner* — Nicholas Lee
(74) *Attorney, Agent, or Firm* — Knobbe, Martens, Olson & Bear, LLP

(57) ABSTRACT

A display device is disclosed. In one aspect, the display device includes a display panel including a plurality of pixels divided into a plurality of block regions. The block regions are arranged in a scan direction. The display device also includes a display panel driver configured to sequentially drive the block regions and apply a plurality of first emission signals to the pixels. Each of the first emission signals has an activation voltage. The display device further includes a timing controller configured to control the display panel driver. The display panel driver is further configured to incrementally change the activation voltages of the first emission signals applied to the pixels in each of the block regions in the scan direction.

20 Claims, 4 Drawing Sheets

DISPLAY DEVICES

CROSS-REFERENCE TO RELATED APPLICATION

This application claims priority under 35 USC §119 to Korean Patent Application No. 10-2014-0183323, filed on Dec. 18, 2014 in the Korean Intellectual Property Office (KIPO), the contents of which are incorporated herein in its entirety by reference.

BACKGROUND

Field

The described technology generally relates to a display device.

Description of the Related Technology

Display devices generate a number of scan signals and emission signals to drive pixels formed on a display panel. The scan signals are applied to the pixels via scan lines. Similarly, the emission signals are applied to the pixels via emission lines. The scan and emission lines may form parasitic capacitances with peripheral terminals, for example, with terminals of transistors included in the pixels. Thus, kickback voltages may be generated (or, caused) at the peripheral terminals when the scan signal and/or the emission signal are changed. In addition, the kickback voltages may not be uniform due to the different locations of the peripheral terminals at which the kickback voltages are generated. For example, a kickback voltage that is generated at the peripheral terminals located in one region may be different from the kickback voltage that is generated at the peripheral terminals located in another region. As a result, an image having non-uniform luminance is displayed by the display panel.

SUMMARY OF CERTAIN INVENTIVE ASPECTS

One inventive aspect is a display device that can drive a display panel to generate substantially uniform kickback voltages at peripheral terminals that form parasitic capacitances with scan lines and emission lines.

Another aspect is a display device including a display panel including a plurality of block regions arranged in a scan direction, a display panel driver configured to sequentially drive the block regions, and a timing controller configured to control the display panel driver. Here, an activation voltage of at least one emission signal that is applied to each of the block regions can be changed in the scan direction.

In example embodiments, the block regions can include first through (n)th block regions, where n is an integer greater than or equal to 2, and the (k)th block region is adjacent to the (k+1)th block region, where k is an integer between 1 and n−1.

In example embodiments, the emission signal for the (k)th block region can be provided to pixels included in the display panel via (k)th emission signal supplying lines.

In example embodiments, the activation voltage of the emission signal for the (k)th block region can be changed based on distances between the (k)th emission signal supplying lines and the (k+1)th block region.

In example embodiments, the activation voltage of the emission signal for the (k)th block region can increase as the distances between the (k)th emission signal supplying lines and the (k+1)th block region increase.

In example embodiments, the activation voltage of the emission signal for the (k)th block region can decrease as the distances between the (k)th emission signal supplying lines and the (k+1)th block region increase.

In example embodiments, the activation voltage of the emission signal for the (k)th block region can be changed to generate substantially uniform kickback voltages at peripheral terminals that form parasitic capacitance with the (k)th emission signal supplying lines as the emission signal for the (k)th block region is changed.

In example embodiments, each of the pixels can include a driving transistor and the peripheral terminals can include a gate electrode of the driving transistor.

In example embodiments, each of the pixels can include a driving transistor and the peripheral terminals can include a source electrode of the driving transistor.

In example embodiments, the emission signal can include a first emission signal and a second emission signal.

In example embodiments, each of the pixels can include a driving transistor having a first electrode, a second electrode, and a gate electrode, a first transistor having a first electrode to which a data signal is applied, a second electrode connected to the gate electrode of the driving transistor, and a gate electrode to which a scan signal is applied, a second transistor having a first electrode to which a first power voltage is applied, a second electrode connected to the first electrode of the driving transistor, and a gate electrode to which the first emission signal is applied, a hold capacitor connected between the first power voltage and the second electrode of the second transistor, a storage capacitor connected between the second electrode of the second transistor and the gate electrode of the driving transistor, a third transistor having a first electrode, a second electrode connected to the second electrode of the driving transistor, and a gate electrode to which the second emission signal is applied, an organic light-emitting diode (OLED) connected between the first electrode of the third transistor and the second power voltage, and a fourth transistor having a first electrode to which an initialization voltage is applied, a second electrode connected to the first electrode of the third transistor, and a gate electrode to which the scan signal is applied.

In example embodiments, the scan signal can include a first activation period and a second activation period. In addition, the first emission signal can be deactivated and the second emission signal can be activated during the first activation period. Furthermore, the first and second emission signals can be deactivated during the second activation period.

In example embodiments, an activation period of the first emission signal can include a first period and a second period. In addition, the scan signal and the second emission signal can be deactivated during the first period. Furthermore, the scan signal can be deactivated and the second emission signal can be activated during the second period.

In example embodiments, the data signal can have a reference voltage during the first activation period.

In example embodiments, the first transistor can provide the data signal having the reference voltage to the gate electrode of the driving transistor during the first activation period.

In example embodiments, the fourth transistor can provide the initialization voltage to the first electrode of the third transistor during the first activation period.

In example embodiments, the third transistor can provide the initialization voltage to the second electrode of the driving transistor during the first activation period.

In example embodiments, the driving transistor can form a channel between the first electrode of the driving transistor and the second electrode of the driving transistor when a voltage difference between the first electrode of the driving transistor and the gate electrode of the driving transistor becomes substantially equal to a threshold voltage of the driving transistor during the first activation period.

In example embodiments, the first transistor can provide the data signal to the gate electrode of the driving transistor during the second activation period.

In example embodiments, the storage capacitor can change a voltage of the first electrode of the driving transistor when a voltage of the gate electrode of the driving transistor is changed during the second activation period.

In example embodiments, an amount of change in the voltage of the first electrode of the driving transistor during the second activation period can be calculated based on [Equation 1]:

$$\Delta V_S = \Delta V_G \times \frac{C_2}{C_1 + C_2},$$

where $\Delta V_S$ denotes the amount of change in the voltage of the first electrode of the driving transistor, $\Delta V_G$ denotes the amount of change in the voltage of the gate electrode of the driving transistor, $C_1$ denotes capacitance of the hold capacitor, and $C_2$ denotes capacitance of the storage capacitor.

In example embodiments, the second transistor can discharge the hold capacitor during the first period.

In example embodiments, the storage capacitor can change the voltage of the gate electrode of the driving transistor when the voltage of the first electrode of the driving transistor is changed during the first period.

In example embodiments, the amount of change in the voltage of the gate electrode of the driving transistor during the first period can be substantially the same as the amount of change in the voltage of the first electrode of the driving transistor during the first period.

In example embodiments, the second transistor can provide the first power voltage to the first electrode of the driving transistor during the second period.

In example embodiments, the driving transistor can generate a driving current based on a voltage difference between the first electrode of the driving transistor and the gate electrode of the driving transistor during the second period.

In example embodiments, the third transistor can connect the driving transistor to the OLED during the second period.

In example embodiments, the OLED can emit light based on the driving current during the second period.

Another aspect is a display device including a display panel including a plurality of block regions arranged in a scan direction, a display panel driver configured to sequentially drive the block regions, and a timing controller configured to control the display panel driver. Here, an activation voltage of a scan signal that is applied to each of the block regions can be changed in the scan direction.

In example embodiments, the block regions can include first through (n)th block regions, where n is an integer greater than or equal to 2, and the (k)th block region is adjacent to the (k+1)th block region, where k is an integer between 1 and n−1.

In example embodiments, the scan signal for the (k)th block region can be provided to pixels included in the display panel via (k)th scan signal supplying lines.

In example embodiments, the activation voltage of the scan signal for the (k)th block region can be changed based on distances between the (k)th scan signal supplying lines and the (k+1)th block region.

In example embodiments, the activation voltage of the scan signal for the (k)th block region can increase as the distances between the (k)th scan signal supplying lines and the (k+1)th block region increase.

In example embodiments, the activation voltage of the scan signal for the (k)th block region can decrease as the distances between the (k)th scan signal supplying lines and the (k+1)th block region increase.

In example embodiments, the activation voltage of the scan signal for the (k)th block region can be changed to generate substantially uniform kickback voltages at peripheral terminals that form parasitic capacitance with the (k)th scan signal supplying lines as the scan signal for the (k)th block region is changed.

Another aspect is a display device, comprising a display panel including a plurality of pixels divided into a plurality of block regions, wherein the block regions are arranged in a scan direction; a display panel driver configured to: i) sequentially drive the block regions and ii) apply a plurality of first emission signals to the pixels, wherein each of the first emission signals has an activation voltage; and a timing controller configured to control the display panel driver, wherein the display panel driver is further configured to incrementally change the activation voltages of the first emission signals applied to the pixels in each of the block regions in the scan direction.

In example embodiments, the display device further comprises a plurality of first emission lines wherein the block regions include first through (n)th block regions, where n is an integer greater than or equal to 2, wherein a (k)th block region is adjacent to a (k+1)th block region, where k is an integer between 1 and n−1, wherein the display panel driver is further configured to apply the first emission signals for the (k)th block region to the corresponding pixels via a plurality of (k)th emission lines, and wherein the display panel driver is further configured to change the activation voltage of the emission signals for the (k)th block region based on the distance between the (k)th emission lines and the (k+1)th block region.

In example embodiments, the display panel driver is further configured to increase the activation voltages of the emission signals for the (k)th block region as the distances between the (k)th emission lines and the (k+1)th block region increase. The display panel driver can be further configured to decrease the activation voltages of the emission signals for the (k)th block region as the distances between the (k)th emission lines and the (k+1)th block region increase.

In example embodiments, the display panel driver is further configured to change the activation voltages of the emission signals for the (k)th block region so as to generate substantially uniform kickback voltages at peripheral terminals that form parasitic capacitances with the (k)th emission lines when the emission signals for the (k)th block region change. Each of the pixels can include a driving transistor including a gate electrode and the peripheral terminals can include the gate electrodes of the driving transistors. Each of the pixels can include a driving transistor including a source electrode and the peripheral terminals can include the source electrodes of the driving transistors.

In example embodiments, the display panel driver is further configured to apply a plurality of second emission signals to the pixels, and wherein each of the pixels includes a driving transistor including: i) a first electrode, ii) a second electrode, and iii) a gate electrode; a first transistor including: i) a first electrode configured to receive a data signal, ii) a second electrode connected to the gate electrode of the driving transistor, and iii) a gate electrode configured to receive a scan signal; a second transistor including: i) a first electrode configured to receive a first power voltage, ii) a second electrode connected to the first electrode of the driving transistor, and iii) a gate electrode configured to receive one of the first emission signals; a hold capacitor connected between the first power voltage and the second electrode of the second transistor; a storage capacitor connected between the second electrode of the second transistor and the gate electrode of the driving transistor; a third transistor including: i) a first electrode, ii) a second electrode connected to the second electrode of the driving transistor, and iii) a gate electrode configured to receive one of the second emission signals; an organic light-emitting diode (OLED) connected between the first electrode of the third transistor and the second power voltage; and a fourth transistor including: i) a first electrode configured to receive an initialization voltage, ii) a second electrode connected to the first electrode of the third transistor, and iii) a gate electrode configured to receive the scan signal.

In example embodiments, the scan signal includes a first activation period and a second activation period, wherein the first emission signals are deactivated and the second emission signals are activated during the first activation period, wherein the first and second emission signals are deactivated during the second activation period, wherein the first emission signals include an activation period having a first period and a second period, wherein the scan signal and the second emission signals are deactivated during the first period, and wherein the scan signal is deactivated and the second emission signals are activated during the second period.

In example embodiments, the data signal has a reference voltage during the first activation period, wherein the first transistor is configured to provide the data signal having the reference voltage to the gate electrode of the driving transistor during the first activation period, wherein the fourth transistor is configured to provide the initialization voltage to the first electrode of the third transistor during the first activation period, wherein the third transistor is configured to provide the initialization voltage to the second electrode of the driving transistor during the first activation period, and wherein the driving transistor is configured to form a channel between the first and second electrodes of the driving transistor when the voltage difference between the first and gate electrodes of the driving transistor are substantially equal to a threshold voltage of the driving transistor during the first activation period.

In example embodiments, the first transistor is configured to provide the data signal to the gate electrode of the driving transistor during the second activation period, and wherein the storage capacitor is configured to change the voltage of the first electrode of the driving transistor when the voltage of the gate electrode of the driving transistor is changed during the second activation period.

In example embodiments, an amount of change in the voltage of the first electrode of the driving transistor during the second activation period is calculated based on [Equation 1]:

$$\Delta V_S = \Delta V_G \times \frac{C_2}{C_1 + C_2}$$

where $\Delta V_S$ denotes the amount of change in the voltage of the first electrode of the driving transistor, $\Delta V_G$ denotes the amount of change in the voltage of the gate electrode of the driving transistor, $C_1$ denotes the capacitance of the hold capacitor, and $C_2$ denotes the capacitance of the storage capacitor.

In example embodiments, the second transistor is configured to discharge the hold capacitor during the first period, and wherein the storage capacitor is configured to change the voltage of the gate electrode of the driving transistor when the voltage of the first electrode of the driving transistor is changed during the first period.

In example embodiments, the amount of change in the voltage of the gate electrode of the driving transistor during the first period is substantially the same as the amount of change in the voltage of the first electrode of the driving transistor during the first period.

In example embodiments, the second transistor is configured to provide the first power voltage to the first electrode of the driving transistor during the second period, wherein the driving transistor is configured to generate a driving current based on the voltage difference between the first electrode of the driving transistor and the gate electrode of the driving transistor during the second period, wherein the third transistor is configured to connect the driving transistor to the OLED during the second period, and wherein the OLED is configured to emit light based on the driving current during the second period.

Another aspect is a display device, comprising a display panel including a plurality of pixels divided into a plurality of block regions, wherein the block regions are arranged in a scan direction; a display panel driver configured to: i) sequentially drive the block regions and ii) apply a plurality of scan signals to the pixels, wherein each of the scan signals has an activation voltage; and a timing controller configured to control the display panel driver, wherein the display panel driver is further configure to change the activation voltage of the scan signals applied to the pixels in each of the block regions in the scan direction.

In example embodiments, the block regions include first through (n)th block regions, where n is an integer greater than or equal to 2, wherein a (k)th block region is adjacent to a (k+1)th block region, where k is an integer between 1 and n−1, wherein the display panel driver is further configured to apply the scan signal for the (k)th block region to the pixels via a plurality of (k)th scan lines, and wherein the display panel driver is further configured to change the activation voltage of the scan signals for the (k)th block region based on the distances between the (k)th scan lines and the (k+1)th block region.

In example embodiments, the display panel driver is further configured to increase the activation voltage of the scan signals for the (k)th block region as the distances between the (k)th scan lines and the (k+1)th block region increase.

In example embodiments, the display panel driver is further configured to decrease the activation voltage of the scan signal for the (k)th block region as the distances between the (k)th scan lines and the (k+1)th block region increase.

In example embodiments, the display panel driver is further configured to change the activation voltage of the scan signal for the (k)th block region so as to generate substantially uniform kickback voltages at peripheral terminals that form parasitic capacitance with the (k)th scan lines as the scan signals for the (k)th block region change.

Therefore, according to at least one embodiment, the display device can generate substantially uniform kickback voltages at peripheral terminals that form parasitic capacitance with scan signal supplying lines and emission signal supplying lines by changing an activation voltage of an emission signal and/or an activation voltage of a scan signal in a scan direction.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF CERTAIN INVENTIVE EMBODIMENTS

Hereinafter, the described technology will be explained in detail with reference to the accompanying drawings.

Figure 1:
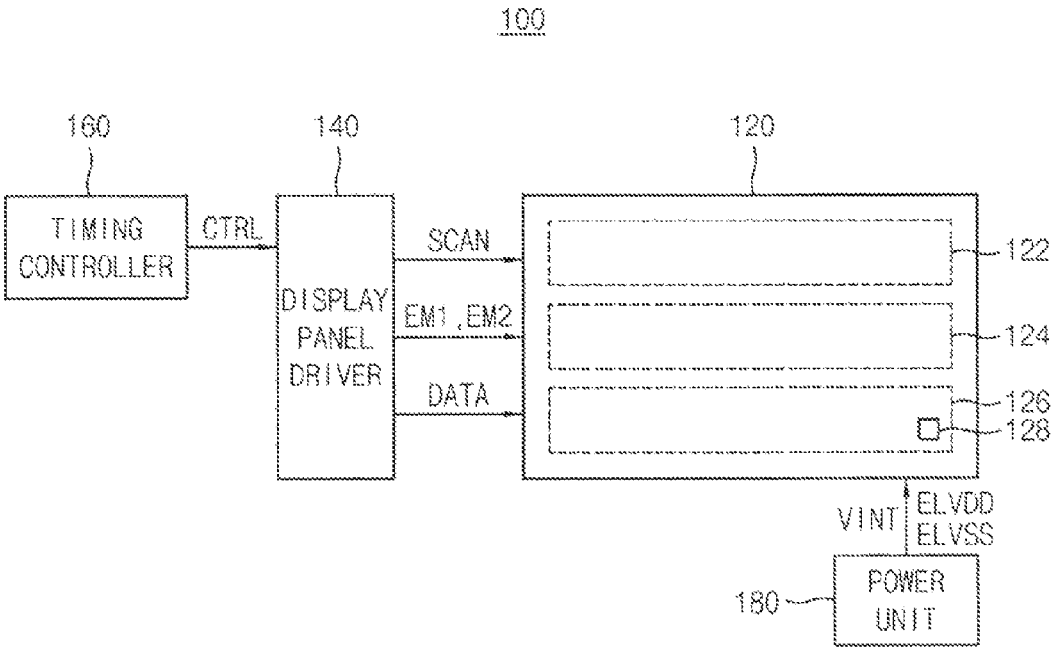
FIG. 1 is a block diagram illustrating a display device according to example embodiments.

FIG. 1 is a block diagram illustrating a display device according to example embodiments.

Referring to FIG. 1, the display device 100 includes a display panel 120, a display panel driver 140, and a timing controller 160. The display panel 120 includes a plurality of pixels 128. In example embodiments, the display panel 100 further includes a power unit or power supply 180.

The display panel 120 can be divided into block regions 122, 124, and 126 in a scan direction. Thus, the pixels 128 are located in the block regions 122, 124, and 126. The pixels 128 receive scan signals SCAN via scan signal supplying lines or scan lines. The pixels 128 receive emission signals EM1 and EM2 via emission signal supplying lines or emission lines. Here, the scan direction may be substantially perpendicular to a direction in which the scan signal supplying lines are formed (i.e., the direction in which the scan supplying lines extend).

In example embodiments, the block regions 122, 124, and 126 include first through (n)th block regions, where n is an integer greater than or equal to 2. In addition, the (k)th block region is adjacent to the (k+1)th block region, where k is an integer between 1 and n−1. For example, for convenience of description, only three block regions (i.e., the first through third block regions 122, 124, and 126) are illustrated in FIG. 1. That is, the display panel 120 can be divided into the first block region 122, the second block region 124, and the third block region 126. In addition, the first block region 122 is adjacent to the second block region 124, and the second block region 124 is adjacent to the third block region 126.

In example embodiments, the emission signals EM1 and EM2 includes the first emission signal EM1 (e.g., referred to as a voltage-coupling emission signal) and the second emission signal EM2 (e.g., referred to as a current-coupling emission signal). In addition, each pixel 128 includes a driving transistor, a first transistor, a second transistor, a hold capacitor, a storage capacitor, a third transistor, an organic light-emitting diode (OLED), and a fourth transistor.

The driving transistor includes a first electrode, a second electrode, and a gate electrode. The driving transistor generates a driving current.

The first transistor includes a first electrode, a second electrode, and a gate electrode. Here, a data signal DATA is applied to the first electrode of the first transistor. The second electrode of the first transistor is connected to the gate electrode of the driving transistor. A scan signal SCAN is applied to the gate electrode of the first transistor.

The second transistor includes a first electrode, a second electrode, and a gate electrode. Here, a first power voltage ELVDD is applied to the first electrode of the second transistor. The second electrode of the second transistor is connected to the first electrode of the driving transistor. The first emission signal EM1 is applied to the gate electrode of the second transistor.

The hold capacitor is connected between the first power voltage ELVDD and the second electrode of the second transistor. In addition, the storage capacitor is connected between the second electrode of the second transistor and the gate electrode of the driving transistor.

The third transistor includes a first electrode, a second electrode, and a gate electrode. Here, the second electrode of the third transistor is connected to the second electrode of the driving transistor. The second emission signal EM2 is applied to the gate electrode of the third transistor.

The OLED is connected between the first electrode of the third transistor and the second power voltage ELVSS. The OLED may emit light based on the driving current generated by the driving transistor.

The fourth transistor includes a first electrode, a second electrode, and a gate electrode. Here, an initialization voltage VINT is applied to the first electrode of the fourth transistor. The second electrode of the fourth transistor is connected to the first electrode of the third transistor. The scan signal SCAN is applied to the gate electrode of the fourth transistor.

In example embodiments, the scan signal SCAN includes a first activation period and a second activation period. During the first activation period, the first emission signal is deactivated and the second emission signal EM2 is activated. During the second activation period, the first emission signal and the second emission signal is deactivated.

In addition, the first emission signal EM1 includes an activation period. The activation period of the first emission signal EM1 includes a first period and a second period. During the first period of the activation period of the first emission signal EM1, the scan signal SCAN and the second emission signal EM2 are deactivated. During the second period of the activation period of the first emission signal EM1, the scan signal SCAN is deactivated and the second emission signal EM2 is activated.

The data signal DATA has a reference voltage during the first activation period. In addition, during the first activation period, the first transistor is turned on. Thus, during the first activation period, the first transistor provides the data signal DATA having the reference voltage to the gate electrode of the driving transistor. As a result, the gate electrode of the driving transistor is initialized to have the reference voltage.

During the first activation period, the third and fourth transistors are turned on. Thus, during the first activation period, the fourth transistor provides the initialization voltage VINT to the first electrode of the third transistor. In addition, during the first activation period, the third transistor provides the initialization voltage VINT to the second electrode of the driving transistor.

In the first activation period, the driving transistor forms a channel between the first electrode of the driving transistor and the second electrode of the driving transistor when a voltage difference between the first electrode of the driving transistor and the gate electrode of the driving transistor becomes substantially equal to a threshold voltage of the driving transistor. Since current flows through the channel between the first electrode of the driving transistor and the second electrode of the driving transistor, the amount of charge stored in the hold capacitor and the storage capacitor is changed. Additionally, since the channel between the first electrode of the driving transistor and the second electrode of the driving transistor disappears when the voltage difference between the first electrode of the driving transistor and the gate electrode of the driving transistor is less than the threshold voltage of the driving transistor, the voltage difference between the first electrode of the driving transistor and the gate electrode of the driving transistor may converge on the threshold voltage of the driving transistor. As a result, the amount of charge corresponding to the threshold voltage of the driving transistor is stored in the storage capacitor, thereby performing a threshold voltage compensating operation.

For example, the driving transistor may be a p-channel metal oxide semiconductor (PMOS) transistor. In this embodiment, when the reference voltage is set to be sufficiently lower than a voltage of the first electrode of the driving transistor, the channel is formed between the first electrode of the driving transistor and the second electrode of the driving transistor. Here, charge stored in the hold capacitor and the storage capacitor flows through the channel formed in the driving transistor. Thus, the amount of the charge stored in the hold capacitor and the storage capacitor is changed. As the amount of the charge stored in the hold capacitor and the storage capacitor is changed, the voltage difference between the gate electrode of the driving transistor and the first electrode of the driving transistor becomes closer to the threshold voltage of the driving transistor. In addition, since the reference voltage is applied to the gate electrode of the driving transistor, a voltage of the first electrode of the driving transistor becomes closer to a voltage that is higher than the reference voltage by the threshold voltage of the driving transistor. When the voltage difference between the gate electrode of the driving transistor and the first electrode of the driving transistor becomes less than the threshold voltage of the driving transistor, the channel between the first electrode of the driving transistor and the second electrode of the driving transistor disappears. Thus, the voltage difference between the first electrode of the driving transistor and the gate electrode of the driving transistor converges on the threshold voltage of the driving transistor. That is, the voltage of the first electrode of the driving transistor converges on the voltage that is higher than the reference voltage by the threshold voltage of the driving transistor. Here, the storage capacitor stores an amount of charge which corresponds to the product of capacitance of the storage capacitor and the threshold voltage of the driving transistor.

The first transistor is turned on during the second activation period. Thus, during the second activation period, the first transistor provides the data signal DATA to the gate electrode of the driving transistor.

During the second activation period, the storage capacitor changes the voltage of the first electrode of the driving transistor when the voltage of the gate electrode of the driving transistor is changed. The first electrode of the driving transistor is allowed to float during the second activation period. Thus, kickback voltages may be generated (or, caused) at the first electrode of the driving transistor through the storage capacitor. In example embodiments, the amount of change in the voltage of the first electrode of the driving transistor during the second activation period can be calculated based on [Equation 1] below.

$$\Delta V_S = \Delta V_G \times \frac{C_2}{C_1 + C_2} \quad \text{[EQUATION 1]}$$

Here, $\Delta V_S$ denotes the amount of change in the voltage of the first electrode of the driving transistor during the second activation period, $\Delta V_G$ denotes the amount of change in the voltage of the gate electrode of the driving transistor during the second activation period, $C_1$ denotes the capacitance of the hold capacitor, and $C_2$ denotes the capacitance of the storage capacitor.

For example, the voltage of the gate electrode of the driving transistor can be changed from the reference voltage to the voltage of the data signal DATA. That is, the amount of change $\Delta V_G$ of the voltage of the gate electrode of the driving transistor can be the voltage difference between the voltage of the data signal DATA and the reference voltage. Thus, the voltage of the first electrode of the driving transistor can be calculated based on [Equation 2] below.

$$V_S = V_{REF} + V_{th} + \Delta V_G \times \frac{C_2}{C_1 + C_2} \quad \text{[EQUATION 2]}$$

Here, $V_S$ denotes the voltage of the first electrode of the driving transistor, $V_{REF}$ denotes the reference voltage, $V_{th}$ denotes the threshold voltage of the driving transistor, $\Delta V_G$ denotes the amount of change in the voltage of the gate electrode of the driving transistor during the second activation period, $C_1$ denotes the capacitance of the hold capacitor, and $C_2$ denotes the capacitance of the storage capacitor.

During the first period of the activation period of the first emission signal EM1, the second transistor is turned on. Thus, during the first period of the activation period of the first emission signal EM1, the second transistor applies the first power voltage ELVDD to the hold capacitor. As a result, the hold capacitor is discharged during the first period of the activation period of the first emission signal EM1.

The storage capacitor changes the voltage of the gate electrode of the driving transistor as the voltage of the first electrode of the driving transistor is changed during the first period of the activation period of the first emission signal EM1. The gate electrode of the driving transistor is allowed to float during the first period of the activation period of the first emission signal EM1. Thus, the kickback voltage may be generated (or, caused) at the gate electrode of the driving transistor through the storage capacitor. In example embodiments, the amount of change in the voltage of the gate electrode of the driving transistor during the first period of the activation period of the first emission signal EM1 is substantially the same as the amount of change in the voltage of the first electrode of the driving transistor during the first period of the activation period of the first emission signal EM1. As described above, the gate electrode of the driving transistor is connected to only the storage capacitor, whereas the first electrode of the driving transistor is connected to the storage capacitor and the hold capacitor. Thus, the amount of change in the voltage of the gate electrode of the driving transistor during the first period of the activation period of the first emission signal EM1 is substantially the same as the amount of change in the voltage of the first electrode of the driving transistor during the first period of the activation period of the first emission signal EM1.

For example, the voltage of the first electrode of the driving transistor is changed from the value calculated based on [Equation 2] to a value corresponding to the first power voltage ELVDD. That is, the amount of change in the voltage of the first electrode of the driving transistor is equal to the difference between the value calculated based on [Equation 2] and the value corresponding to the first power voltage ELVDD. As a result, the voltage of the gate electrode of the driving transistor can be calculated based on [Equation 3] below.

$$V_G = \text{DATA} + ELVDD - V_{REF} - V_{th} - \Delta V_G \times \frac{C_2}{C_1 + C_2} \quad \text{[EQUATION 3]}$$

Here, $V_G$ denotes the voltage of the gate electrode of the driving transistor, DATA denotes the voltage of the data signal, ELVDD denotes the first power voltage, $V_{REF}$ denotes the reference voltage, $V_{th}$ denotes the threshold voltage of the driving transistor, $\Delta V_G$ denotes the amount of change in the voltage of the gate electrode of the driving transistor during the second activation period, $C_1$ denotes the capacitance of the hold capacitor, and $C_2$ denotes the capacitance of the storage capacitor.

Thus, the voltage difference between the first electrode of the driving transistor and the gate electrode of the driving transistor can be calculated based on [Equation 4] below.

$$V_{sg} = -\text{DATA} + V_{REF} + V_{th} + \Delta V_G \times \frac{C_2}{C_1 + C_2} \quad \text{[EQUATION 4]}$$

Here, $V_{sg}$ denotes the voltage difference between the first electrode of the driving transistor and the gate electrode of the driving transistor, DATA denotes the voltage of the data signal, $V_{REF}$ denotes the reference voltage, $V_{th}$ denotes the threshold voltage of the driving transistor, $\Delta V_G$ denotes the amount of change in the voltage of the gate electrode of the driving transistor during the second activation period, $C_1$ denotes the capacitance of the hold capacitor, and $C_2$ denotes the capacitance of the storage capacitor.

The voltage difference between the first electrode of the driving transistor and the gate electrode of the driving transistor is stored in the storage capacitor and maintained until the first transistor is turned on.

The second and third transistors are turned on during the second period of the activation period of the first emission signal EM1. Thus, the second transistor provides the first power voltage ELVDD to the first electrode of the driving transistor during the second period of the activation period of the first emission signal EM1. In addition, the third transistor connects the driving transistor to the OLED during the second period of the activation period of the first emission signal EM1.

During the second period of the activation period of the first emission signal EM1, the driving transistor generates the driving current based on the voltage difference between the first electrode of the driving transistor and the gate electrode of the driving transistor. Here, the driving transistor may operate in a saturation region. Since the voltage difference between the first electrode of the driving transistor and the gate electrode of the driving transistor is maintained during the second period of the activation period of the first emission signal EM1, the driving transistor generates the driving current based on the voltage difference stored in the storage capacitor. For example, the driving current can be generated based on the voltage difference that is calculated based on [Equation 4]. The driving transistor can generate the driving current regardless of the threshold voltage of the driving current because [Equation 4] for calculating the voltage difference between the first electrode of the driving transistor and the gate electrode of the driving transistor includes an expression related to the threshold voltage $V_{th}$ of the driving transistor.

The display panel driver 140 sequentially drives the block regions 122, 124, and 126. In other words, the display panel driver 140 sequentially drives the display panel 120 in block region units. In addition, the display panel driver 140 generates the data signal DATA.

In example embodiments, each pixel 128 includes the driving transistor and the storage capacitor. The storage capacitor is connected between a gate electrode of the driving transistor and a source electrode of the driving transistor. The display panel driver 140 sequentially performs a data storing operation in block region units. For example, the display panel driver 140 performs the data storing operation on the first block region 122, performs the data storing operation on the second block region 124, and then performs the data storing operation on the third block region 126. Here, the data storing operation refers to an operation that stores the voltage difference between the gate electrode of the driving transistor and the source electrode of the driving transistor by charging the storage capacitor.

In example embodiments, the display panel driver 140 sequentially performs a threshold voltage compensating operation in block region units. For example, the display panel driver 140 performs the threshold voltage compensating operation on the first block region 122, performs the threshold voltage compensating operation on the second block region 124, and then performs the threshold voltage compensating operation on the third block region 126. Here, the threshold voltage compensating operation refers to an operation that compensates the threshold voltage of the driving transistors.

The activation voltages of the emission signals EM1 and EM2 that are provided to each of the block regions 122, 124, and 126 can be changed in the scan direction. Here, the display panel driver 140 provides the emission signals EM1 and EM2 to the first block region 122 via first emission signal supplying lines, provides the emission signals EM1 and EM2 to the second block region 124 via second emission signal supplying lines, and provides the emission signals EM1 and EM2 to the third block region 126 via third emission signal supplying lines. For example, the display panel driver 140 provides the emission signals EM1 and EM2 to the first block region 122 via the first emission signal supplying lines. Here, the activation voltages of the emission signals EM1 and EM2 applied to an upper line of the first emission signal supplying lines may have a first voltage level, the activation voltages of the emission signals EM1 and EM2 applied to a lower line of the first emission signal supplying lines may have a second voltage level, and the first voltage level may be different from the second voltage level. In a similar way, the display panel driver 140 provides the emission signals EM1 and EM2 to the second block region 124 via the second emission signal supplying lines and provides the emission signals EM1 and EM2 to the third block region 126 via the third emission signal supplying lines.

The activation voltage of the scan signal SCAN that is provided to each of the block regions 122, 124, and 126 can be changed in the scan direction. Here, the display panel driver 140 provides the scan signal SCAN to the first block region 122 via first scan signal supplying lines, provides the scan signal SCAN to the second block region 124 via second scan signal supplying lines, and provides the scan signal SCAN to the third block region 126 via third scan signal supplying lines. For example, the display panel driver 140 provides the scan signal SCAN to the first block region 122 via the first scan signal supplying lines. Here, the activation voltage of the scan signal SCAN applied to an upper line of the first scan signal supplying lines may have a first voltage level, the activation voltage of the scan signal SCAN applied to a lower line of the first scan signal supplying lines may have a second voltage level, and the first voltage level may be different from the second voltage level. In a similar way, the display panel driver 140 provides the scan signal SCAN to the second block region 124 via the second scan signal supplying lines, and provides the scan signal SCAN to the third block region 126 via the third scan signal supplying lines.

The emission signals EM1 and EM2 for the (k)th block region are provided to the display panel 120 via the (k)th emission signal supplying lines. That is, the pixels 128 included in the (k)th block region receive the emission signals EM1 and EM2 via the (k)th emission signal supplying lines. In addition, the activation voltages of the emission signals EM1 and EM2 for the (k)th block region can be changed based on the distances between the (k)th emission signal supplying lines and the (k+1)th block region. For example, the emission signals EM1 and EM2 for the first block region 122 are provided to the pixels 128 included in the display panel 120 via the first emission signal supplying lines, the emission signals EM1 and EM2 for the second block region 124 are provided to the pixels 128 included in the display panel 120 via the second emission signal supplying lines, and the emission signals EM1 and EM2 for the third block region 126 are provided to the pixels 128 included in the display panel 120 via the third emission signal supplying lines. Here, the activation voltages of the emission signals EM1 and EM2 for the first block region 122 can be changed based on the distances between the first emission signal supplying lines and the second block region 124, and the activation voltages of the emission signals EM1 and EM2 for the second block region 124 can be changed based on the distances between the second emission signal supplying lines and the third block region 126.

The scan signal SCAN for the (k)th block region is provided to the display panel 120 via the (k)th scan signal supplying lines. That is, the pixels 128 included in the (k)th block region receive the scan signal SCAN via the (k)th scan signal supplying lines. In addition, the activation voltage of the scan signal SCAN for the (k)th block region can be changed based on distances between the (k)th scan signal supplying lines and the (k+1)th block region. For example, the scan signal SCAN for the first block region 122 is provided to the pixels 128 included in the display panel 120 via the first scan signal supplying lines, the scan signal SCAN for the second block region 124 is provided to the pixels 128 included in the display panel 120 via the second scan signal supplying lines, and the scan signal SCAN for the third block region 126 is provided to the pixels 128 included in the display panel 120 via the third scan signal supplying lines. Here, the activation voltage of the scan signal SCAN for the first block region 122 can be changed based on the distances between the first scan signal supplying lines and the second block region 124, and the activation voltage of the scan signal SCAN for the second block region 124 can be changed based on the distances between the second scan signal supplying lines and the third block region 126.

In example embodiments, the activation voltages of the emission signals EM1 and EM2 for the (k)th block region can be changed to generate (or, cause) substantially uniform kickback voltages at peripheral terminals that form parasitic capacitances with the (k)th emission signal supplying lines as the emission signals EM1 and EM2 for the (k)th block region are changed. In addition, the activation voltage of the scan signal SCAN for the (k)th block region can be changed to generate substantially uniform kickback voltages at peripheral terminals that form parasitic capacitance with the (k)th scan signal supplying lines as the scan signal SCAN for the (k)th block region is changed.

In example embodiments, each pixel 128 includes the driving transistor, and the peripheral terminals include the gate electrode of the driving transistor. In example embodiments, each pixel 128 includes the driving transistor, and the peripheral terminals include the source electrode of the driving transistor. The driving transistor generates the driving current based on the voltage difference between the gate electrode of the driving transistor and the source electrode of the driving transistor. Thus, when the kickback voltages generated (or, caused) at the gate electrodes of the driving transistors and/or the source electrodes of the driving transistors are substantially uniform, luminance of light output from the pixels 128 is substantially uniform. Meanwhile, when the display panel driver 140 sequentially drives the display panel 120 in block region units, the kickback voltages generated at the peripheral terminals located in edges of the block region 122, 124, and 126 may be different from the kickback voltages generated at the peripheral terminals located in a center of the block region 122, 124, and 126. Thus, the kickback voltages generated at the peripheral terminals can be substantially equalized by changing the activation voltages of the emission signals EM1 and EM2 and/or the activation voltage of the scan signal SCAN in the scan direction.

In an example embodiment, the activation voltages of the emission signals EM1 and EM2 for the (k)th block region increase as the distances between the (k)th emission signal supplying lines and the (k+1)th block region increase. For example, the activation voltages of the emission signals EM1 and EM2 for the first block region 122 increase as the distances between the first emission signal supplying lines and the second block region 124 increase, and the activation voltages of the emission signals EM1 and EM2 for the second block region 124 increase as the distances between the second emission signal supplying lines and the third block region 126 increase. As a result, the substantially uniform kickback voltages can be generated at the peripheral terminals. In addition, the activation voltage of the scan signal SCAN for the (k)th block region increase as the distances between the (k)th scan signal supplying lines and the (k+1)th block region increase. For example, the activation voltage of the scan signal SCAN for the first block region 122 increases as the distances between the first scan signal supplying lines and the second block region 124 increase and the activation voltage of the scan signal SCAN for the second block region 124 increase as the distances between the second scan signal supplying lines and the third block region 126 increase. As a result, the substantially uniform kickback voltages can be generated at the peripheral terminals.

In another example embodiment, the activation voltages of the emission signals EM1 and EM2 for the (k)th block region decreases as the distances between the (k)th emission signal supplying lines and the (k+1)th block region increase. For example, the activation voltages of the emission signals EM1 and EM2 for the first block region 122 decrease as the distances between the first emission signal supplying lines and the second block region 124 increase and the activation voltages of the emission signals EM1 and EM2 for the second block region 124 decrease as the distances between the second emission signal supplying lines and the third block region 126 increase. As a result, the substantially uniform kickback voltages can be generated at the peripheral terminals. In addition, the activation voltage of the scan signal SCAN for the (k)th block region decrease as the distances between the (k)th scan signal supplying lines and the (k+1)th block region increase. For example, the activation voltage of the scan signal SCAN for the first block region 122 decrease as the distances between the first scan signal supplying lines and the second block region 124 increase and the activation voltage of the scan signal SCAN for the second block region 124 decrease as the distances between the second scan signal supplying lines and the third block region 126 increase. As a result, the substantially uniform kickback voltages can be generated at the peripheral terminals.

The timing controller 160 controls the display panel driver 140. The timing controller 160 generates a display panel driver control signal CTRL. The display panel driver 140 generates the scan signal SCAN, the emission signals EM1 and EM2, and the data signal DATA based on the display panel driver control signal CTRL.

As described above, the display panel driver 140 can generate (or, cause) the substantially uniform kickback voltages at the peripheral terminals (i.e., can substantially equalize the kickback voltages generated at the peripheral terminals) by changing the activation voltages of the emission signals EM1 and EM2 and/or the activation voltage of the scan signal SCAN in the scan direction.

Figure 2:
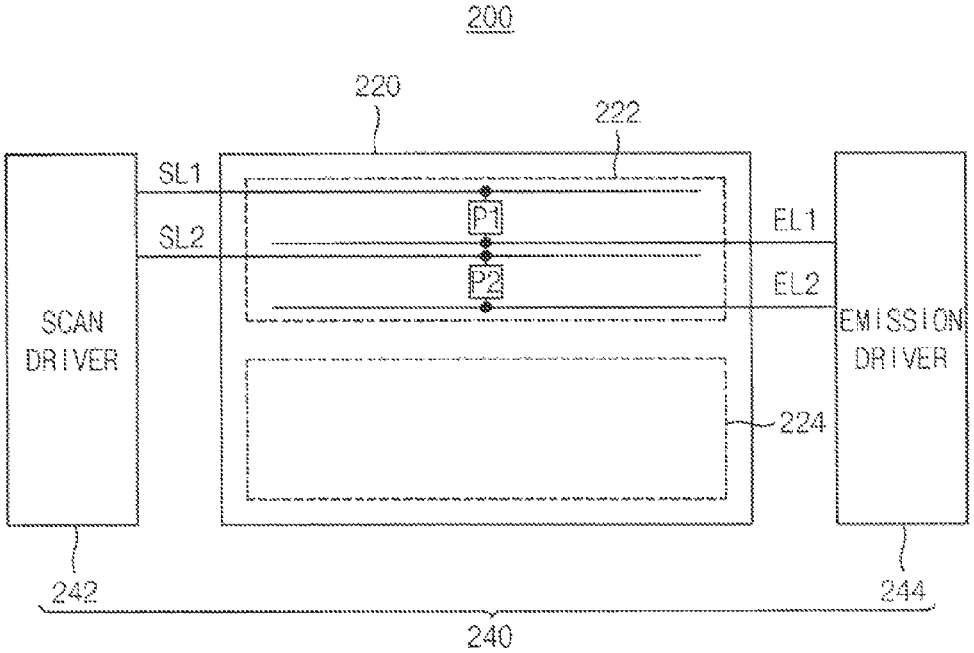
FIG. 2 is a diagram illustrating emission signal supplying lines and scan signal supplying lines included in the display device of FIG. 1.

FIG. 2 is a diagram illustrating emission signal supplying lines and scan signal supplying lines included in the display device of FIG. 1.

Referring to FIG. 2, the display device 200 includes a display panel 220, a display panel driver 240, and a timing controller. The display panel 220 includes a plurality of pixels P1 and P2. The display panel 220 is divided into a plurality of block regions 222 and 224 in a scan direction. The display panel driver 240 includes a scan driver 242 and an emission driver 244.

Specifically, the activation voltages of emission signals applied to each of the block regions 222 and 224 can be changed in a scan direction. For example, the emission driver 244 provides the emission signals to the first block region 222. To this end, the emission driver 244 applies the emission signals to the first emission signal supplying lines EL1 and EL2. Here, the activation voltages of the emission signals applied to an upper line (e.g., EL1) of the first emission signal supplying lines EL1 and EL2 can have a first voltage level, the activation voltages of the emission signals applied to a lower line (e.g., EL2) of the first emission signal supplying lines can have a second voltage level, and the first voltage level can be different from the second voltage level.

In addition, an activation voltage of a scan signal applied to each of the block regions 222 and 224 can be changed in the scan direction. For example, the scan driver 242 can provide the scan signal to the first block region 222. To this end, the scan driver 242 can apply the scan signal to the first scan signal supplying lines SL1 and SL2. Here, the activation voltage of the scan signal applied to an upper line (e.g., SL1) of the first scan signal supplying lines SL1 and SL2 can have a first voltage level, the activation voltage of the scan signal applied to a lower line (e.g., SL2) of the first scan signal supplying lines can have a second voltage level, and the first voltage level can be different from the second voltage level.

The emission signals for the (k)th block region are provided to the display panel 220 via the (k)th emission signal supplying lines. That is, the pixels P1 and P2 included in the (k)th block region receive the emission signals via the (k)th emission signal supplying lines. In addition, the activation voltages of the emission signals for the (k)th block region can be changed based on the distances between the (k)th emission signal supplying lines and the (k+1)th block region. For example, the emission signals for the first block region 222 are provided to the pixels P1 and P2 included in the display panel 220 via the first emission signal supplying lines EL1 and EL2. Here, the activation voltages of the emission signals for the first block region 222 can be changed based on the distances between the first emission signal supplying lines EL1 and EL2 and the second block region 224.

The scan signal for the (k)th block region are provided to the display panel 220 via the (k)th scan signal supplying lines. That is, the pixels P1 and P2 included in the (k)th block region may receive the scan signal via the (k)th scan signal supplying lines. In addition, the activation voltage of the scan signal for the (k)th block region can be changed based on the distances between the (k)th scan signal supplying lines and the (k+1)th block region. For example, the scan signal for the first block region 222 can be provided to the pixels P1 and P2 included in the display panel 220 via the first scan signal supplying lines SL1 and SL2. Here, the activation voltage of the scan signal for the first block region 222 can be changed based on the distances between the first scan signal supplying lines SL1 and SL2 and the second block region 224.

In example embodiments, the activation voltages of the emission signals for the (k)th block region can be changed to generate (or, cause) substantially uniform kickback voltages at peripheral terminals that form parasitic capacitance with the (k)th emission signal supplying lines as the emission signals for the (k)th block region are changed. In addition, the activation voltage of the scan signal for the (k)th block region can be changed to generate substantially uniform kickback voltages at peripheral terminals that form parasitic capacitance with the (k)th scan signal supplying lines as the scan signal for the (k)th block region is changed.

In an example embodiment, the activation voltages of the emission signals for the (k)th block region increase as the distances between the (k)th emission signal supplying lines and the (k+1)th block region increase. For example, the activation voltages of the emission signals for the first block region 222 can increase as the distances between the first emission signal supplying lines and the second block region 224 increase. As a result, the substantially uniform kickback voltages can be generated at the peripheral terminals. In addition, the activation voltage of the scan signal for the (k)th block region can increase as the distances between the (k)th scan signal supplying lines and the (k+1)th block region increase. For example, the activation voltage of the scan signal for the first block region 222 can increase as the distances between the first scan signal supplying lines and the second block region 224 increase. As a result, the substantially uniform kickback voltages can be generated at the peripheral terminals.

In another example embodiment, the activation voltages of the emission signals for the (k)th block region can decrease as the distances between the (k)th emission signal supplying lines and the (k+1)th block region increase. For example, the activation voltages of the emission signals for the first block region 222 can decrease as the distances between the first emission signal supplying lines and the second block region 224 increase. As a result, the substantially uniform kickback voltages can be generated at the peripheral terminals. In addition, the activation voltage of the scan signal for the (k)th block region can decrease as the distances between the (k)th scan signal supplying lines and the (k+1)th block region increase. For example, the activation voltage of the scan signal for the first block region 222 can decrease as the distances between the first scan signal supplying lines and the second block region 224 increase. As a result, the substantially uniform kickback voltages can be generated at the peripheral terminals.

Figure 3:
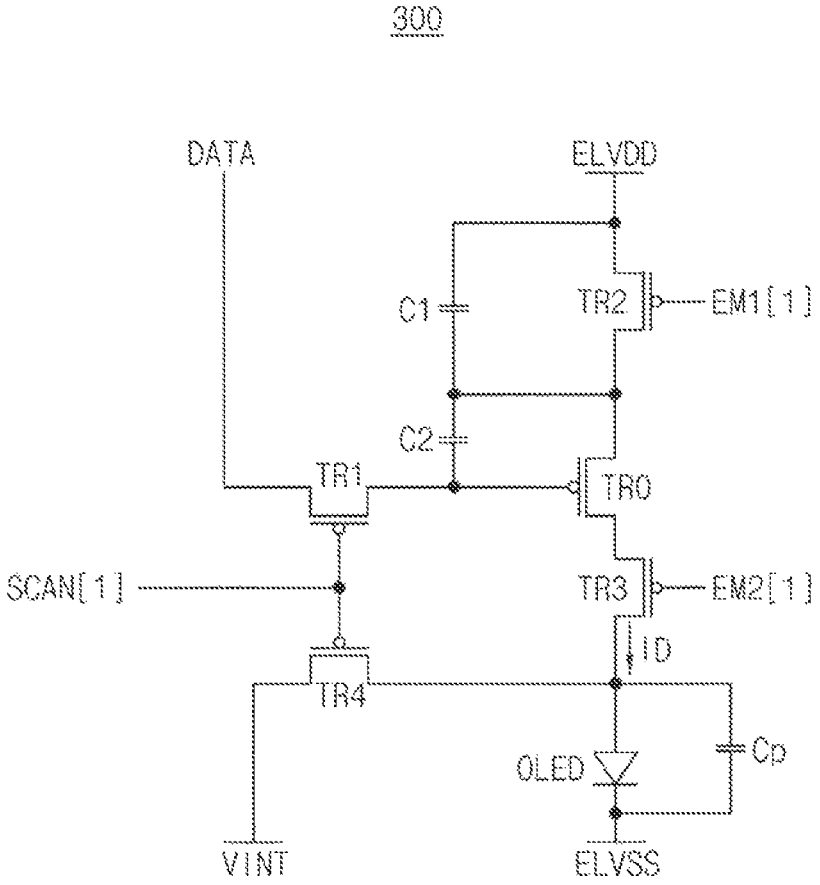
FIG. 3 is a circuit diagram illustrating an example of pixels included in the display device of FIG. 1.
Figure 4:
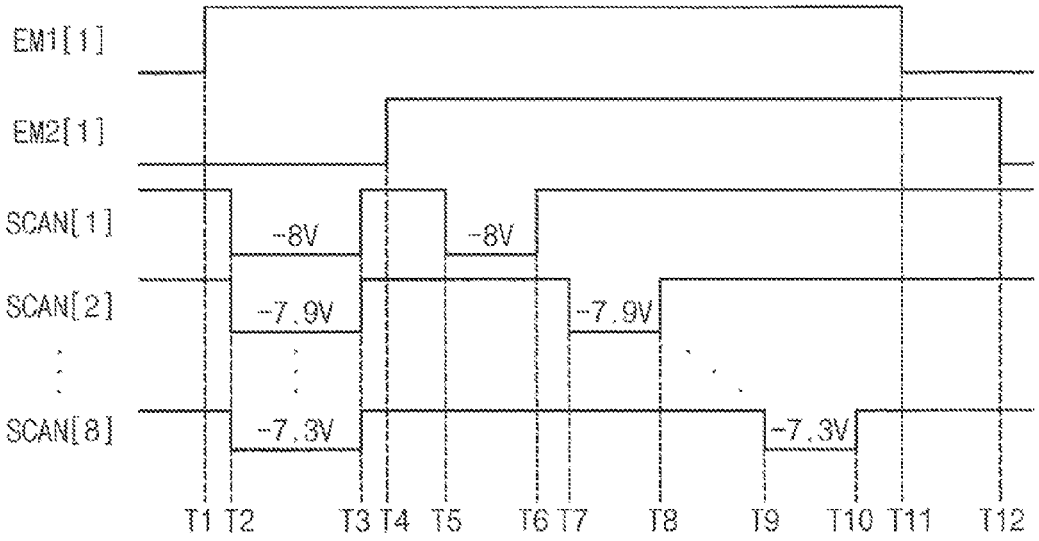
FIG. 4 is a timing diagram illustrating an example in which an emission signal and a scan signal are applied to the pixels of FIG. 3.
Figure 5:
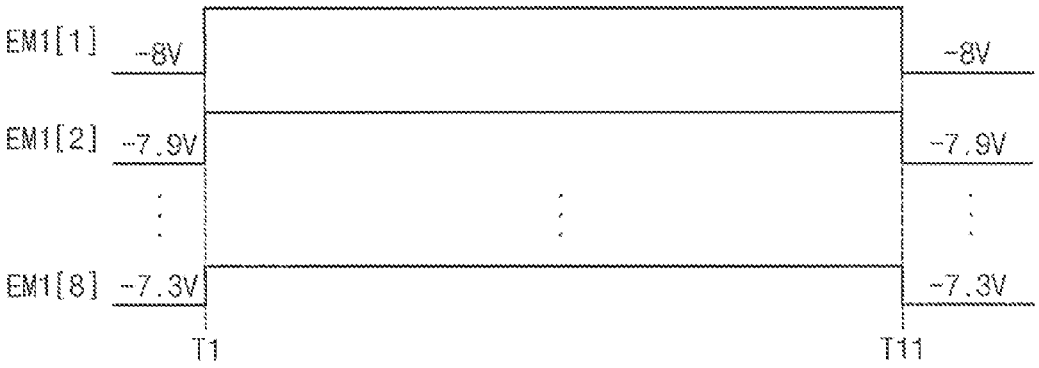
FIG. 5 is a timing diagram illustrating an example in which a first emission signal is applied to the pixels of FIG. 3.
Figure 6:
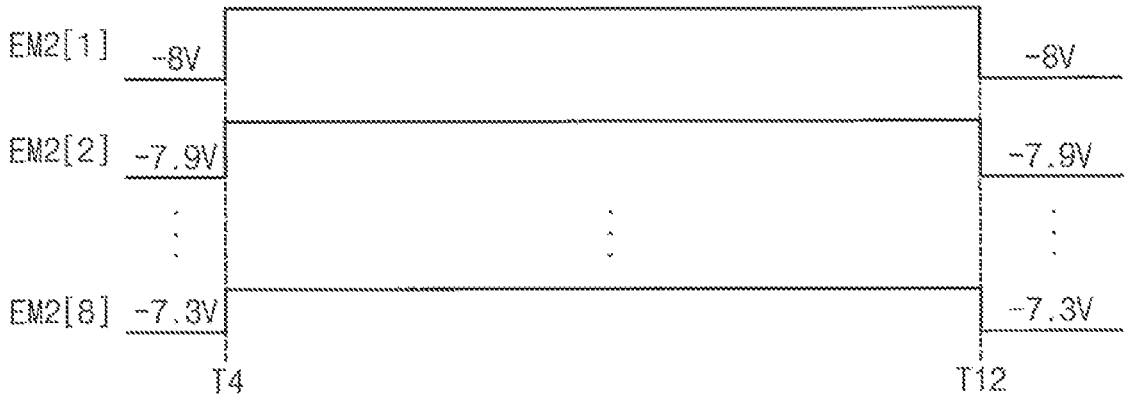
FIG. 6 is a timing diagram illustrating an example in which a second emission signal is applied to the pixels of FIG. 3.

FIG. 3 is a circuit diagram illustrating an example of pixels included in the display device of FIG. 1. FIG. 4 is a timing diagram illustrating an example in which an emission signal and a scan signal are applied to the pixels of FIG. 3. FIG. 5 is a timing diagram illustrating an example in which a first emission signal is applied to the pixels of FIG. 3. FIG. 6 is a timing diagram illustrating an example in which a second emission signal is applied to the pixels of FIG. 3.

Referring to FIGS. 3 through 6, the pixel 300 can include a driving transistor TR0, a first transistor TR1, a second transistor TR2, a hold capacitor C1, a storage capacitor C2, a third transistor TR3, an OLED, and a fourth transistor TR4. In some example embodiments, the pixel 300 includes a parasitic capacitance Cp formed between electrodes of the OLED. Hereinafter, for the sake of clarity, a pixel connected to a (j)th line of emission signal supplying lines and/or scan signal supplying lines will be referred to as a (j)th line pixel, where j is an integer greater than or equal to 1. For example, a pixel connected to a first line of the emission signal supplying lines and/or the scan signal supplying lines is referred to as a first line pixel, a pixel connected to a second line of the emission signal supplying lines and/or the scan signal supplying lines is referred to as a second line pixel, and a pixel connected to a third line of the emission signal supplying lines and/or the scan signal supplying lines is referred to as a third line pixel.

In example embodiments, emission signals EM1[1] and EM2[1] include a first emission signal EM1[1] (e.g., referred to as a voltage-coupling emission signal) and a second emission signal EM2[1] (e.g., referred to as a current-coupling emission signal). In addition, the driving transistor TR0 includes a first electrode, a second electrode, and a gate electrode. The driving transistor TR0 can generate a driving current ID.

The first transistor TR1 includes a first electrode, a second electrode, and a gate electrode. Here, a data signal DATA is applied to the first electrode of the first transistor TR1. The second electrode of the first transistor TR1 is connected to the gate electrode of the driving transistor TR0. A scan signal SCAN[1] is applied to the gate electrode of the first transistor TR1.

The second transistor TR2 includes a first electrode, a second electrode, and a gate electrode. Here, a first power voltage ELVDD is applied to the first electrode of the second transistor TR2. The second electrode of the second transistor TR2 is connected to the first electrode of the driving transistor TR0. The first emission signal EM1[1] is applied to the gate electrode of the second transistor TR2.

The hold capacitor C1 is connected between the first power voltage ELVDD and the second electrode of the second transistor TR2. In addition, the storage capacitor C2 is connected between the second electrode of the second transistor TR2 and the gate electrode of the driving transistor TR0.

The third transistor TR3 includes a first electrode, a second electrode, and a gate electrode. Here, the second electrode of the third transistor TR3 is connected to the second electrode of the driving transistor TR0. The second emission signal EM2[1] is applied to the gate electrode of the third transistor TR3.

The OLED is connected between the first electrode of the third transistor TR3 and the second power voltage ELVSS. The OLED emits light based on the driving current ID generated by the driving transistor TR0.

The fourth transistor TR4 includes a first electrode, a second electrode, and a gate electrode. Here, an initialization voltage VINT is applied to the first electrode of the fourth transistor TR4. The second electrode of the fourth transistor TR4 is connected to the first electrode of the third transistor TR3. The scan signal SCAN[1] is applied to the gate electrode of the fourth transistor TR4.

As illustrated in FIGS. 4 through 6, a display panel driver provides the first emission signals EM1[1] through EM1[8] and the second emission signals EM2[1] through EM2[8] to first through eighth line pixels via first emission signal supplying lines, where the first through eighth line pixels are located in a first block region. As described above, the emission signal supplying lines for the first block region are referred to as the first emission signal supplying lines, the emission signal supplying lines for the second block region are referred to as the second emission signal supplying lines, and the emission signal supplying lines for the third block region are referred to as the third emission signal supplying lines. In addition, the display panel controller provides the scan signals SCAN[1] through SCAN[8] to the first through eighth line pixels via first scan signal supplying lines. As described above, the scan signal supplying lines for the first block region are referred to as the first scan signal supplying lines, the scan signal supplying lines for the second block region are referred to as the second scan signal supplying lines, and the scan signal supplying lines for the third block region are referred to as the third scan signal supplying lines.

The scan signals SCAN[1] through SCAN[8] include a first activation period (i.e., a period between T2 and T3) and a second activation period (i.e., a period between T5 and T6, a period between T7 and T8, and a period between T9 and T10). During the first activation period (i.e., the period between T2 and T3), the first emission signals EM[1] through EM1[8] are deactivated, and the second emission signals EM2[1] through EM2[8] are activated. During the second activation period (i.e., the period between T5 and T6, the period between T7 and T8, and the period between T9 and T10), the first emission signals EM[1] through EM1[8] and the second emission signal EM2[1] through EM2[8] are deactivated.

Here, the period between T5 and T6, the period between T7 and T8, and the period between T9 and T10 of the scan signals SCAN[1] through SCAN[8] applied to each line pixel do not overlap each other. For example, the scan signal SCAN[2] applied to the second line pixels includes the second activation period (i.e., the period between T7 and T8) after the second activation period (i.e., the period between T5 and T6) of the scan signal SCAN[1] applied to the first line pixels. In addition, the activation voltage of the scan signals SCAN[1] through SCAN[8] applied to each line pixel can differ. For example, the activation voltage of the scan signal SCAN[1] applied to the first line pixels can be −8V, the activation voltage of the scan signal SCAN[2] applied to the second line pixels can be −7.9V (e.g., −8V+0.1V), the activation voltage of the scan signal SCAN[3] applied to the third line pixels can be −7.8V (e.g., −8V+0.2V), and the activation voltage of the scan signal SCAN[8] applied to the eighth line pixels can be −7.3V (e.g., −8V+0.7V). However, the activation voltage of the scan signals SCAN[1] through SCAN[8] applied to each line of pixels is not limited thereto.

In addition, the first emission signals EM[1] through EM1[8] include an activation period (i.e., a period between T11 and T1(next)). The activation period (i.e., the period between T11 and T1(next)) of the first emission signals EM1[1] through EM1[8] includes a first period (i.e., a period between T11 and T12) and a second period (i.e., a period between T12 and T1(next)). During the first period (i.e., the period between T11 and T12) of the activation period (i.e., the period between T11 and T1(next)) of the first emission signals EM1[1] through EM1[8], the scan signals SCAN[1] through SCAN[8] and the second emission signals EM2[1] through EM2[8] are deactivated. During the second period (i.e., the period between T12 and T1(next)) of the activation period (i.e., the period between T11 and T1(next)) of the first emission signals EM1[1] through EM1[8], the scan signals SCAN[1] through SCAN[8] are deactivated, and the second emission signals EM2[1] through EM2[8] are activated.

The activation voltage of the first emission signals EM1[1] through EM1[8] applied to each line pixel can differ. For example, the activation voltage of the first emission signal EM1[1] applied to the first line pixels can be −8V, the activation voltage of the first emission signal EM1[2] applied to the second line pixels can be −7.9V (e.g., −8V+0.1V), the activation voltage of the first emission signal EM1[3] applied to the third line pixels can be −7.8V (e.g., −8V+0.2V), and the activation voltage of the first emission signal EM1[8] applied to the eighth line pixels can be −7.3V (e.g., −8V+0.7V). However, the activation voltage of the first emission signal EM1[1] through EM1[8] applied to each line pixel is not limited thereto. The activation voltage of the second emission signal EM2[1] through EM2[8] applied to each line pixel can differ. For example, the activation voltage of the second emission signal EM2[1] applied to the first line pixels can be −8V, the activation voltage of the second emission signal EM2[2] applied to the second line pixels can be −7.9V (e.g., −8V+0.1V), the activation voltage of the second emission signal EM2[3] applied to the third line pixels can be −7.8V (e.g., −8V+0.2V), and the activation voltage of the second emission signal EM2[8] applied to the eighth line pixels can be −7.3V (e.g., −8V+0.7V). However, the activation voltage of the second emission signal EM2[1] through EM2[8] applied to each line of pixels is not limited thereto.

As illustrated in FIGS. 3 and 4, the data signal DATA has a reference voltage during the first activation period (i.e., the period between T2 and T3). In addition, during the first activation period (i.e., the period between T2 and T3), the first transistor TR1 can be turned on. Thus, during the first activation period (i.e., the period between T2 and T3), the first transistor TR1 provides the data signal DATA having the reference voltage to the gate electrode of the driving transistor TR0. As a result, the gate electrode of the driving transistor TR0 is initialized to have the reference voltage.

During the first activation period (i.e., the period between T2 and T3), the third and fourth transistors TR3 and TR4 are turned on. Thus, during the first activation period (i.e., the period between T2 and T3), the fourth transistor TR4 provides the initialization voltage VINT to the first electrode of the third transistor TR3. In addition, during the first activation period (i.e., the period between T2 and T3), the third transistor TR3 provides the initialization voltage VINT to the second electrode of the driving transistor TR0.

In the first activation period (i.e., the period between T2 and T3), the driving transistor TR0 forms a channel between the first electrode of the driving transistor TR0 and the second electrode of the driving transistor TR0 when the voltage difference between the first electrode of the driving transistor TR0 and the gate electrode of the driving transistor TR0 becomes substantially equal to the threshold voltage of the driving transistor TR0. Since current flows through the channel between the first electrode of the driving transistor TR0 and the second electrode of the driving transistor TR0, the amount of charge stored in the hold capacitor C1 and the storage capacitor C2 is changed. Further, since the channel between the first electrode of the driving transistor TR0 and the second electrode of the driving transistor TR0 disappears when the voltage difference between the first electrode of the driving transistor TR0 and the gate electrode of the driving transistor TR0 is less than the threshold voltage of the driving transistor TR0, the voltage difference between the first electrode of the driving transistor TR0 and the gate electrode of the driving transistor TR0 converges on the threshold voltage of the driving transistor TR0. As a result, the charge corresponding to the threshold voltage of the driving transistor TR0 is stored in the storage capacitor C2, thereby performing a threshold voltage compensating operation.

In some embodiments, the driving transistor TR0 is a PMOS transistor. In these embodiments, when the reference voltage is set to be sufficiently lower than a voltage of the first electrode of the driving transistor TR0, the channel is formed between the first electrode of the driving transistor TR0 and the second electrode of the driving transistor TR0. Here, the charge stored in the hold capacitor C1 and the storage capacitor C2 passes through the channel formed in the driving transistor TR0. Thus, the amount of charge stored in the hold capacitor C1 and the storage capacitor C2 is changed. As the amount of charge stored in the hold capacitor C1 and the storage capacitor C2 is changed, the voltage difference between the gate electrode of the driving transistor TR0 and the first electrode of the driving transistor TR0 becomes closer to the threshold voltage of the driving transistor TR0. In addition, since the reference voltage is applied to the gate electrode of the driving transistor TR0, the voltage of the first electrode of the driving transistor TR0 becomes closer to a voltage that is higher than the reference voltage by the threshold voltage of the driving transistor TR0. When the voltage difference between the gate electrode of the driving transistor TR0 and the first electrode of the driving transistor TR0 becomes less than the threshold voltage of the driving transistor TR0, the channel between the first electrode of the driving transistor TR0 and the second electrode of the driving transistor TR0 disappears. Thus, the voltage difference between the first electrode of the driving transistor TR0 and the gate electrode of the driving transistor TR0 converges on the threshold voltage of the driving transistor TR0. That is, the voltage of the first electrode of the driving transistor TR0 converges on the voltage that is higher than the reference voltage by the threshold voltage of the driving transistor TR0. Here, the storage capacitor C2 stores an amount charge corresponding to the product of the capacitance of the storage capacitor C2 and the threshold voltage of the driving transistor TR0.

The first transistor TR1 is turned on during the second activation period (i.e., the period between T5 and T6). Thus, during the second activation period (i.e., the period between T5 and T6), the first transistor TR1 provides the data signal DATA to the gate electrode of the driving transistor TR0.

During the second activation period (i.e., the period between T5 and T6), the storage capacitor C2 changes the voltage of the first electrode of the driving transistor TR0 when the voltage of the gate electrode of the driving transistor TR0 is changed. The first electrode of the driving transistor TR0 is allowed to float during the second activation period (i.e., the period between T5 and T6). Thus, a kickback voltage may be generated (or, caused) at the first electrode of the driving transistor TR0 through the storage capacitor C2. In example embodiments, the amount of change in the voltage of the first electrode of the driving transistor TR0 during the second activation period (i.e., the period between T5 and T6) can be calculated based on [Equation 1] above.

For example, the voltage of the gate electrode of the driving transistor TR0 can be changed from the reference voltage to the voltage of the data signal DATA. That is, the amount of change $\Delta V_G$ in the voltage of the gate electrode of the driving transistor TR0 can be a voltage difference between the voltage of the data signal DATA and the reference voltage. Thus, the voltage of the first electrode of the driving transistor TR0 can be calculated based on [Equation 2] above.

During the first period (i.e., the period between T11 and T12), the second transistor TR2 is turned on. Thus, during the first period (i.e., the period between T11 and T12), the second transistor TR2 provides the first power voltage ELVDD to the hold capacitor C1. As a result, the hold capacitor C1 is discharged during the first period (i.e., the period between T11 and T12).

The storage capacitor C2 changes the voltage of the gate electrode of the driving transistor TR0 as the voltage of the first electrode of the driving transistor TR0 is changed during the first period (i.e., the period between T11 and T12). The gate electrode of the driving transistor TR0 is allowed to float during the first period (i.e., the period between T11 and T12). Thus, the kickback voltage can be generated (or, caused) at the gate electrode of the driving transistor TR0 through the storage capacitor C2. In example embodiments, the amount of change in the voltage of the gate electrode of the driving transistor TR0 during the first period (i.e., the period between T11 and T12) can be substantially the same as the amount of change in the voltage of the first electrode of the driving transistor TR0 during the first period (i.e., the period between T11 and T12). As described above, the gate electrode of the driving transistor TR0 is connected to only the storage capacitor C2, whereas the first electrode of the driving transistor TR0 is connected to the storage capacitor C2 and the hold capacitor C1. Thus, the amount of change in the voltage of the gate electrode of the driving transistor TR0 during the first period (i.e., the period between T11 and T12) can be substantially the same as the amount of change in the voltage of the first electrode of the driving transistor TR0 during the first period (i.e., the period between T11 and T12).

For example, the voltage of the first electrode of the driving transistor TR0 can be changed from a value calculated based on [Equation 2] to a value corresponding to the first power voltage ELVDD. That is, the amount of change in the voltage of the first electrode of the driving transistor TR0 can be substantially equal to the difference between the value calculated based on [Equation 2] and the value corresponding to the first power voltage ELVDD. As a result, the voltage of the gate electrode of the driving transistor TR0 can be calculated based on [Equation 3] above.

Thus, the voltage difference between the first electrode of the driving transistor TR0 and the gate electrode of the driving transistor TR0 can be calculated based on [Equation 4] above.

The voltage difference between the first electrode of the driving transistor TR0 and the gate electrode of the driving transistor TR0 can be stored in the storage capacitor C2 and maintained until the first transistor TR1 is turned on.

The second and third transistors TR2 and TR3 are turned on during the second period (i.e., the period between T12 and T1(next)). Thus, the second transistor TR2 provides the first power voltage ELVDD to the first electrode of the driving transistor TR0 during the second period (i.e., the period between T12 and T1(next)). In addition, the third transistor TR3 electrically connects the driving transistor TR0 to the OLED during the second period (i.e., the period between T12 and T1(next)).

During the second period (i.e., the period between T12 and T1(next)), the driving transistor TR0 generates the driving current ID based on the voltage difference between the first electrode of the driving transistor TR0 and the gate electrode of the driving transistor TR0. Here, the driving transistor TR0 operates in a saturation region. Since the voltage difference between the first electrode of the driving transistor TR0 and the gate electrode of the driving transistor TR0 is maintained during the second period (i.e., the period between T12 and T1(next)), the driving transistor TR0 generates the driving current ID based on the voltage difference stored in the storage capacitor C2. For example, the driving current ID can be generated based on the voltage difference that is calculated based on [Equation 4] above. The driving transistor TR0 can generate the driving current ID regardless of the threshold voltage of the driving transistor TR0 because [Equation 4] for calculating the voltage difference between the first electrode of the driving transistor TR0 and the gate electrode of the driving transistor TR0 includes an expression related to the threshold voltage Vth of the driving transistor TR0.

The kickback voltages can be generated (or, caused) when the first emission signals EM[1] through EM1[8], the second emission signals EM2[1] through EM2[8], and/or the scan signals SCAN[1] through SCAN[8] are changed. Generally, the signals EM[1] through EM1[8], EM2[1] through EM2[8], and SCAN[1] through SCAN[8] have an activation voltage or a deactivation voltage. That is, the respective voltages of the signals EM[1] through EM1[8], EM2[1] through EM2[8], and SCAN[1] through SCAN[8] are changed from the activation voltage to the deactivation voltage (i.e., deactivated) and are changed from the deactivation voltage to the activation voltage (i.e., activated). Thus, the generated kickback voltage can be cancelled out (or, may disappear) by voltage changes of the signals EM[1] through EM1[8], EM2[1] through EM2[8], and SCAN[1] through SCAN[8]. However, under some conditions, the generated kickback voltage may not be cancelled out. For example, the kickback voltage generated at the gate electrode of the driving transistor TR0 as the first emission signal EM1[1] through EM1[8] is deactivated (i.e., indicated as T1) may not be cancelled out when the first emission signal EM1[1] through EM1[8] is activated (i.e., indicated as T11) because the voltage of the gate electrode of the driving transistor TR0 is changed based on the data signal DATA after the first emission signal EM1[1] through EM1[8] is deactivated (i.e., indicated as T1).

In brief, the display panel driver can substantially equalize the kickback voltages generated at the peripheral terminals by changing the activation voltage of the first emission signals EM1[1] through EM1[8], the activation voltage of the second emission signals EM2[1] through EM2[8], and/or the activation voltage of the scan signals SCAN[1] through SCAN[8] in the scan direction.

Although a display device according to example embodiments has been described above with reference to FIGS. 1 through 6, those skilled in the art will readily appreciate that many modifications are possible in the example embodiments without materially departing from the novel teachings and advantages of the described technology. For example, although it is described above that emission signals include a first emission signal EM1 (e.g., referred to as a voltage-coupling emission signal) and a second emission signal EM2 (e.g., referred to as a current-coupling emission signal), the emission signals are not limited thereto.

The described technology can be applied to an electronic device including a display device. For example, the described technology can be applied to a computer, a laptop, a digital camera, a video camcorder, a cellular phone, a smart phone, a smart pad, a tablet PC, a personal digital assistant (PDA), a portable multimedia player (PMP), an MP3 player, a car navigation system, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the invention as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device, comprising:

a display panel including a plurality of pixels divided into a plurality of block regions, wherein the block regions are arranged in a scan direction;

a display panel driver configured to: i) sequentially drive the block regions and ii) apply a plurality of first emission signals to the pixels, wherein each of the first emission signals has an activation voltage; and a timing controller configured to control the display panel driver, wherein the display panel driver is further configured to incrementally change the activation voltages of the first emission signals applied to the pixels in each of the block regions in the scan direction.

2. The display device of claim 1, further comprising a plurality of first emission lines, wherein the block regions include first through (n)th block regions, where n is an integer greater than or equal to 2, wherein a (k)th block region is adjacent to a (k+1)th block region, where k is an integer between 1 and n−1, wherein the display panel driver is further configured to apply the first emission signals for the (k)th block region to the corresponding pixels via a plurality of (k)th emission lines, and wherein the display panel driver is further configured to change the activation voltage of the emission signals for the (k)th block region based on the distance between the (k)th emission lines and the (k+1)th block region.

3. The display device of claim 2, wherein the display panel driver is further configured to increase the activation voltages of the emission signals for the (k)th block region as the distances between the (k)th emission lines and the (k+1)th block region increase.

4. The display device of claim 2, wherein the display panel driver is further configured to decrease the activation voltages of the emission signals for the (k)th block region as the distances between the (k)th emission lines and the (k+1)th block region increase.

5. The display device of claim 2, wherein the display panel driver is further configured to change the activation voltages of the emission signals for the (k)th block region so as to generate substantially uniform kickback voltages at peripheral terminals that form parasitic capacitances with the (k)th emission lines when the emission signals for the (k)th block region change.

6. The display device of claim 5, wherein each of the pixels includes a driving transistor including a gate electrode and wherein the peripheral terminals include the gate electrodes of the driving transistors.

7. The display device of claim 5, wherein each of the pixels includes a driving transistor including a source electrode and wherein the peripheral terminals include the source electrodes of the driving transistors.

8. The display device of claim 2, wherein the display panel driver is further configured to apply a plurality of second emission signals to the pixels, and wherein each of the pixels includes:

a driving transistor including: i) a first electrode, ii) a second electrode, and iii) a gate electrode;

a first transistor including: i) a first electrode configured to receive a data signal, ii) a second electrode connected to the gate electrode of the driving transistor, and iii) a gate electrode configured to receive a scan signal;

a second transistor including: i) a first electrode configured to receive a first power voltage, ii) a second electrode connected to the first electrode of the driving transistor, and iii) a gate electrode configured to receive one of the first emission signals;

a hold capacitor connected between the first power voltage and the second electrode of the second transistor;

a storage capacitor connected between the second electrode of the second transistor and the gate electrode of the driving transistor;

a third transistor including: i) a first electrode, ii) a second electrode connected to the second electrode of the driving transistor, and iii) a gate electrode configured to receive one of the second emission signals;

an organic light-emitting diode (OLED) connected between the first electrode of the third transistor and the second power voltage; and a fourth transistor including: i) a first electrode configured to receive an initialization voltage, ii) a second electrode connected to the first electrode of the third transistor, and iii) a gate electrode configured to receive the scan signal.

9. The display device of claim 8, wherein the scan signal includes a first activation period and a second activation period, wherein the first emission signals are deactivated and the second emission signals are activated during the first activation period, wherein the first and second emission signals are deactivated during the second activation period, wherein the first emission signals include an activation period having a first period and a second period, wherein the scan signal and the second emission signals are deactivated during the first period, and wherein the scan signal is deactivated and the second emission signals are activated during the second period.

10. The display device of claim 9, wherein the data signal has a reference voltage during the first activation period, wherein the first transistor is configured to provide the data signal having the reference voltage to the gate electrode of the driving transistor during the first activation period, wherein the fourth transistor is configured to provide the initialization voltage to the first electrode of the third transistor during the first activation period, wherein the third transistor is configured to provide the initialization voltage to the second electrode of the driving transistor during the first activation period, and wherein the driving transistor is configured to form a channel between the first and second electrodes of the driving transistor when the voltage difference between the first and gate electrodes of the driving transistor are substantially equal to a threshold voltage of the driving transistor during the first activation period.

11. The display device of claim 10, wherein the first transistor is configured to provide the data signal to the gate electrode of the driving transistor during the second activation period, and wherein the storage capacitor is configured to change the voltage of the first electrode of the driving transistor when the voltage of the gate electrode of the driving transistor is changed during the second activation period.

12. The display device of claim 11, wherein an amount of change in the voltage of the first electrode of the driving transistor during the second activation period is calculated based on [Equation 1]:

$$\Delta V_S = \Delta V_G \times \frac{C_2}{C_1 + C_2}$$

where $\Delta V_S$ denotes the amount of change in the voltage of the first electrode of the driving transistor, $\Delta V_G$ denotes the amount of change in the voltage of the gate electrode of the driving transistor, $C_1$ denotes the capacitance of the hold capacitor, and $C_2$ denotes the capacitance of the storage capacitor.

13. The display device of claim 11, wherein the second transistor is configured to discharge the hold capacitor during the first period, and wherein the storage capacitor is configured to change the voltage of the gate electrode of the driving transistor when the voltage of the first electrode of the driving transistor is changed during the first period.

14. The display device of claim 13, wherein the amount of change in the voltage of the gate electrode of the driving transistor during the first period is substantially the same as the amount of change in the voltage of the first electrode of the driving transistor during the first period.

15. The display device of claim 13, wherein the second transistor is configured to provide the first power voltage to the first electrode of the driving transistor during the second period, wherein the driving transistor is configured to generate a driving current based on the voltage difference between the first electrode of the driving transistor and the gate electrode of the driving transistor during the second period, wherein the third transistor is configured to connect the driving transistor to the OLED during the second period, and wherein the OLED is configured to emit light based on the driving current during the second period.

16. A display device comprising:

a display panel including a plurality of pixels divided into a plurality of block regions, wherein the block regions are arranged in a scan direction;

a display panel driver configured to: i) sequentially drive the block regions and ii) apply a plurality of scan signals to the pixels, wherein each of the scan signals has an activation voltage; and a timing controller configured to control the display panel driver, wherein the display panel driver is further configure to change the activation voltage of the scan signals applied to the pixels in each of the block regions in the scan direction.

17. The display device of claim 16, wherein the block regions include first through (n)th block regions, where n is an integer greater than or equal to 2, wherein a (k)th block region is adjacent to a (k+1)th block region, where k is an integer between 1 and n−1, wherein the display panel driver is further configured to apply the scan signal for the (k)th block region to the pixels via a plurality of (k)th scan lines, and wherein the display panel driver is further configured to change the activation voltage of the scan signals for the (k)th block region based on the distances between the (k)th scan lines and the (k+1)th block region.

18. The display device of claim 17, wherein the display panel driver is further configured to increase the activation voltage of the scan signals for the (k)th block region as the distances between the (k)th scan lines and the (k+1)th block region increase.

19. The display device of claim 17, wherein the display panel driver is further configured to decrease the activation voltage of the scan signal for the (k)th block region as the distances between the (k)th scan lines and the (k+1)th block region increase.

20. The display device of claim 17, wherein the display panel driver is further configured to change the activation voltage of the scan signal for the (k)th block region so as to generate substantially uniform kickback voltages at peripheral terminals that form parasitic capacitance with the (k)th scan lines as the scan signals for the (k)th block region change.

* * * * *